US008509970B2

(12) United States Patent
Kane et al.

(10) Patent No.: US 8,509,970 B2
(45) Date of Patent: Aug. 13, 2013

(54) VITAL SPEED PROFILE TO CONTROL A TRAIN MOVING ALONG A TRACK

(75) Inventors: Mark Edward Kane, Orange Park, FL (US); Harrison Thomas Hickenlooper, Palatka, FL (US)

(73) Assignee: Invensys Rail Corporation, Louisville, KY (US)

( * ) Notice: Subject to any disclaimer, the term of this patent is extended or adjusted under 35 U.S.C. 154(b) by 1068 days.

(21) Appl. No.: 12/495,378

(22) Filed: Jun. 30, 2009
(Under 37 CFR 1.47)

(65) Prior Publication Data

US 2010/0332058 A1 Dec. 30, 2010

(51) Int. Cl.
*B60T 8/00* (2006.01)

(52) U.S. Cl.
USPC ..... 701/20; 701/29.7; 701/30.6; 246/182 A; 246/182 C; 246/182 R

(58) Field of Classification Search
USPC ..... 701/20, 29.2, 29.7, 30.6; 246/182 R, 246/182 A, 182 C; 700/21
See application file for complete search history.

(56) References Cited

U.S. PATENT DOCUMENTS

| | | | | |
|---|---|---|---|---|
| 3,527,986 | A | 9/1970 | Darrow | |
| 3,553,488 | A | 1/1971 | Darrow | |
| 4,017,044 | A * | 4/1977 | Anderson et al. | 246/182 B |
| 4,181,943 | A | 1/1980 | Mercer, Sr. et al. | |
| 4,209,828 | A * | 6/1980 | Anderson et al. | 701/20 |
| 4,217,643 | A * | 8/1980 | Anderson et al. | 701/20 |
| 4,234,922 | A * | 11/1980 | Wilde et al. | 701/20 |
| 4,368,440 | A * | 1/1983 | Darrow | 333/172 |
| 4,384,250 | A * | 5/1983 | Darrow | 324/161 |
| 4,459,668 | A * | 7/1984 | Inoue et al. | 701/20 |
| 4,495,578 | A * | 1/1985 | Sibley et al. | 701/20 |
| 4,558,415 | A * | 12/1985 | Zuber et al. | 701/20 |
| 4,561,057 | A | 12/1985 | Haley, Jr. et al. | |

(Continued)

FOREIGN PATENT DOCUMENTS

| | | |
|---|---|---|
| CA | 2185084 C | 4/2000 |
| DE | 196 36 108 | 3/1998 |
| DE | 197 01 800 | 7/1998 |
| WO | WO 01/86317 | 11/2001 |

OTHER PUBLICATIONS

B. Petit, "Communications-Based Signaling (CBS)—Vital PTC," presented at AREMA C&S Technical Conference, May 22, 2007.*

(Continued)

*Primary Examiner* — Thomas Black
*Assistant Examiner* — Peter D Nolan
(74) *Attorney, Agent, or Firm* — DLA Piper LLP US

(57) ABSTRACT

A speed profile for an entire train trip includes a maximum allowable speed at each point of the entire trip, taking into account the ability of the train to comply with speed reductions encountered during the trip. The speed profile includes a braking curve that gradually reduces from a higher speed to a lower speed starting at a point at which the train must begin braking in order to be traveling at the lower speed when the train reaches the point at which the lower speed limit begins. The speed profile is generated on multiple wayside computers, cross checked, and then vitally transmitted to an onboard locomotive control system. The onboard control system includes redundant speed sensors with redundant vital circuits, and also includes redundant speed comparators to ensure that the train doesn't exceed the speed profile. A GPS receiver may be used for greater reliability.

10 Claims, 2 Drawing Sheets

(56) References Cited

U.S. PATENT DOCUMENTS 4,710,880 A * 12/1987 Zuber ..... 701/20
4,711,418 A 12/1987 Aver, Jr. et al.
4,740,972 A * 4/1988 Rutherford, Jr. ..... 714/807
5,072,900 A 12/1991 Malon
5,129,605 A 7/1992 Burns et al.
5,177,685 A 1/1993 Davis et al.
5,267,473 A 12/1993 Bezos et al.
5,309,140 A * 5/1994 Everett et al. ..... 340/466
5,332,180 A 7/1994 Peterson et al.
5,340,062 A 8/1994 Heggestad
5,361,212 A 11/1994 Class et al.
5,364,047 A * 11/1994 Petit et al. ..... 246/122 R
5,377,938 A 1/1995 Bezos et al.
5,383,717 A 1/1995 Fernandez et al.
5,394,333 A 2/1995 Kao
5,398,894 A 3/1995 Pascoe
5,452,870 A * 9/1995 Heggestad ..... 246/182 R
5,453,942 A * 9/1995 Wood et al. ..... 702/148
5,507,457 A 4/1996 Kull
5,533,695 A 7/1996 Heggestad et al.
5,590,966 A 1/1997 Cherny et al.
5,610,616 A 3/1997 Vallot et al.
5,620,155 A 4/1997 Michalek
5,621,646 A 4/1997 Enge et al.
5,699,986 A 12/1997 Welk
5,736,923 A 4/1998 Saab
5,740,547 A 4/1998 Kull et al.
5,747,685 A 5/1998 Skantar
5,751,569 A 5/1998 Metel et al.
5,757,291 A 5/1998 Kull
5,785,283 A 7/1998 Ehrenberger et al.
5,803,411 A 9/1998 Ackerman et al.
5,817,934 A 10/1998 Skantar
5,828,979 A 10/1998 Polivka et al.
5,836,529 A 11/1998 Gibbs
5,866,811 A 2/1999 Skantar
5,867,122 A 2/1999 Zahm et al.
5,898,102 A 4/1999 Skantar
5,944,768 A 8/1999 Ito et al.
5,956,664 A 9/1999 Bryan
5,978,718 A 11/1999 Kull
5,995,881 A 11/1999 Kull
6,008,731 A 12/1999 Capan
6,049,745 A 4/2000 Douglas et al.
6,067,484 A 5/2000 Rowson et al.
6,081,769 A 6/2000 Curtis
6,087,950 A 7/2000 Capan
6,095,618 A 8/2000 Heneka et al.
6,102,340 A 8/2000 Peek et al.
6,112,142 A 8/2000 Shockley et al.
6,128,501 A 10/2000 Ffoulkes-Jones
6,135,396 A 10/2000 Whitfield et al.
6,144,901 A 11/2000 Nickles et al.
6,179,252 B1 1/2001 Roop et al.
6,195,600 B1 2/2001 Kettle, Jr.
6,218,961 B1 4/2001 Gross et al.
6,227,625 B1 5/2001 Gaughan
6,236,185 B1 5/2001 Hines et al.
6,311,109 B1 10/2001 Hawthorne et al.
6,322,025 B1 11/2001 Colbert et al.
6,345,233 B1 2/2002 Erick
6,353,780 B1 * 3/2002 Hart ..... 701/20
6,371,416 B1 4/2002 Hawthorne
6,373,403 B1 4/2002 Korver et al.
6,374,184 B1 4/2002 Zahm et al.
6,377,877 B1 4/2002 Doner
6,385,532 B1 5/2002 Dance et al.
6,397,147 B1 5/2002 Whitehead
6,421,587 B2 7/2002 Diana et al.
6,456,937 B1 9/2002 Doner et al.
6,459,964 B1 10/2002 Vu et al.
6,459,965 B1 10/2002 Polivka et al.
6,470,245 B1 10/2002 Proulx
6,480,766 B2 11/2002 Hawthorne et al.
6,487,478 B1 11/2002 Azzaro et al.
6,505,104 B2 1/2003 Collins
6,600,979 B1 * 7/2003 Kumar et al. ..... 701/20
6,609,049 B1 8/2003 Kane et al.
6,622,067 B1 9/2003 Lovelace, II et al.
6,641,090 B2 11/2003 Meyer
6,668,216 B2 12/2003 Mays
6,704,228 B2 3/2004 Jang et al.
6,721,657 B2 4/2004 Ford et al.
6,824,110 B2 11/2004 Kane et al.
6,845,953 B2 1/2005 Kane et al.
6,853,888 B2 2/2005 Kane et al.
6,862,502 B2 3/2005 Peltz et al.
6,863,246 B2 3/2005 Kane et al.
6,865,454 B2 3/2005 Kane et al.
6,903,658 B2 6/2005 Kane et al.
6,915,191 B2 7/2005 Kane et al.
6,957,131 B2 10/2005 Kane et al.
6,996,461 B2 2/2006 Kane et al.
7,073,753 B2 7/2006 Root et al.
7,096,096 B2 8/2006 Kane et al.
7,222,003 B2 5/2007 Stull et al.
7,467,032 B2 12/2008 Kane et al.
7,557,748 B1 7/2009 Zahm et al.
7,650,207 B2 1/2010 Metzger
7,679,298 B2 * 3/2010 Kumar ..... 318/66
7,722,134 B2 * 5/2010 Kane ..... 303/128
7,769,544 B2 8/2010 Blesener et al.
8,229,607 B2 * 7/2012 Hrdlicka et al. ..... 701/20
8,234,023 B2 * 7/2012 Kumar ..... 701/20
8,271,153 B2 * 9/2012 Kumar ..... 701/19
8,296,065 B2 * 10/2012 Haynie et al. ..... 701/505
2001/0056544 A1 12/2001 Walker
2002/0004693 A1 1/2002 Collins
2002/0049520 A1 4/2002 Mays
2002/0070879 A1 6/2002 Gazit et al.
2003/0144772 A1 7/2003 Proulx
2003/0183729 A1 10/2003 Root et al.
2003/0222981 A1 12/2003 Kisak et al.
2003/0225490 A1 12/2003 Kane et al.
2003/0236598 A1 12/2003 Villarreal Antelo et al.
2004/0120305 A1 6/2004 Aiken, II et al.
2005/0004722 A1 1/2005 Kane et al.
2005/0065726 A1 3/2005 Meyer et al.
2005/0107954 A1 5/2005 Nahla
2006/0017611 A1 1/2006 Hatch et al.
2006/0271291 A1 11/2006 Meyer
2006/0286965 A1 12/2006 Lauridsen et al.
2007/0095988 A1 * 5/2007 Kane et al. ..... 246/182 R
2007/0141988 A1 6/2007 Kuehnel et al.
2007/0170314 A1 7/2007 Kane et al.
2009/0115633 A1 * 5/2009 Lawry et al. ..... 340/936
2010/0241296 A1 * 9/2010 Rhea et al. ..... 701/20
2010/0312461 A1 * 12/2010 Haynie et al. ..... 701/117

OTHER PUBLICATIONS

"Trainlink® ATX (Air Turbine) End of Train Telementry Device," www.elpasohub.org/ATH.htm as printed Sep. 10, 2004 (3 pages).
www.elpasohuborg/images/images10.gif as printed Sep. 10, 2004 (1 page).
"Testimony of Jolene M. Molitoris, Federal Railroad Aministrator, US Dept. of Transportation before the House Committee on Transportation and Infrastructure Subcommittee on Railroads," Federal Railroad Aministration, US Dept. of Transportation, Apr. 1, 1998 (23 pages).
"System Architecture, ATCS Specification 100," May 1995 (27 pages).
"A New World for Communications & Signaling," Progressive Railroading, pp. 29-35, May 1986.
"Advanced Train Control Gains Momentum," Progressive Railroading, pp. 56-58, Mar. 1986.
"Railroads Take High Tech in Stride," Progressive Railroading, pp. 43-45, May 1985.
Lyle, Denise, "Positive Train Control on CSXT," Railway Fuel and Operation Officiers Association, Annual Proceedings, pp. 127-135, 2000.
Lindsey, Ron A., "C B T M, Communications Based Train Management," Railway Fuel and Operating Officers Association, Annual Proceedings, pp. 36-47, 1999.

Moody, Howard G., Advanced Train Control Systems A System to manage Railroad Operation, Railway Fuel and Operation Officers Association, Annual Proceedings, pp. 155-164, 1993.
Ruegg, G.A., "Advanced Train Control Systems ATCS," Railway Fuel and Operation Officers Association, Annual Proceedings, pp. 189-195, 1986.
Malone, Frank, "The Gaps Start to Close," Progressive Railroading, pp. 36-40, May 1987.
"On the Threshold of ATCS," Progressive Railroading, pp. 33-34, Dec. 1987.
"CP Advances in Train Control," Prgressive Railroading, pp. 72-73, Sep. 1987.
"Communications/Signaling: Vital for Dramatic Railroad Advances," Progressive Railroading, pp. 27-32, May 1988.
"ATCS's System Engineer," Progressive Railroading, pp. 43-46, Jul. 1988.
"The Electronic Railroad Emerges," Progressive Railroading, pp. 23-30, May 1989.
"C3 Comes to the Railroads," Progressive Railroading, pp. 43-48, Sep. 1989.
"ATCS on Verge of Implementation," Progressive Railroading, pp. 33-40, Dec. 1989.
"ATCS Evolving on Railroads," Progressive Railroading, pp. 24-32, Dec. 1992.
"High Tech Advances keep Railroads Rolling," Progressive Railroading, pp. 41-50, May 1994.
"FRA Promotes Technology to Avoid Train-To-Train Collisions," Progressive Railroading, Aug. 1994.
"ATCS Moving Slowly But Steadily From Lab for Field", Progressive Railroading, pp. 30-38, Dec. 1994.
Judge, T., "Electronic Advances Keeping Railroads Rolling," Progressive Railroading, pp. 35-47, Jun. 1995.
"Electronic Advances Improve How Railroads Manage," Progressive Railroading, pp. 35-45, Dec. 1995.
Judge, T., "BNSF/UP PTS Pilot Advances in Northwest," Progressive Railroading, pp. 49-53, May 1996.
Foran, P., "Train Control Quandary, Is CBTC Viable? Railroads, Suppliers Hope Pilot Projects Provide Clues," Progressive Railroading, pp. 32-40, Jun. 1997.
"PTS Would've Prevented Silver Spring Crash: NTSB," Progressive Railroading, pp. 18-21, Jul. 1997.
Foran, P., "A 'Positive' Answer to the Interoperability Call," Progressive Railroading, pp. 52-56, Sep. 1997.
Foran, P., "How Safe is Safe Enough?," Progressive Railroading, pp. 24-27, Oct. 1997.
Foran, P., "A Controlling Interest in Inoperability," Progressive Railroading, pp. 51-56, Apr. 1998.
Derocher, Robert J., "Transit Projects Setting Pace for Train Control," Progressive Railroading, pp. 79-81, Jun. 1998.
Kube, K., "Variations on a Theme," Progressive Railroading, pp. 39-43, Dec. 2001.
Kube, K., "Innovation in Inches," Progressive Railroading, pp. 38-42, Feb. 2002.
Vantuono, W., "New York Leads a Revolution," Railway Age, pp. 89-92, Sep. 1996.
Vantuono, W., "Do You Know Where Your Train Is?," Railway Age, pp. 41-42, Feb. 1996.
Gallamore, R., "The Curtain Rises on the Next Generation," Railway Age, pp. 40-42, Jul. 1998.
Burke, J., "How R&D is Shaping the 21st Century Railroad," Railway Age, pp. 55-60 and 83, Aug. 1998.
Vantuono, W., "CBTC: A Maturing Technology," Third International Conference on Communications Based Train Control, Railway Age, pp. 37-43, Jun. 1999.
Sullivan, T., "PTC—Is FRA Pushing Too Hard?," Railway Age, Aug. 1999 (5 pages).
Sullivan, T., "PTC: A Maturing Technology," Railway Age, pp. 55-57, Apr. 2000.
Moore, W., "How CBTC Can Increase Capacity," Railway Age, Apr. 2001 (3 pages).
Vantuono, W., "CBTC: The Jury is Still Out," Railway Age, Jun. 2001 (3 pages).
Vantuono, W., "New-Tech Train Control Takes Off," Railway Age, pp. 41-46, May 2002.
Union Switch & Signal Intermittent Cab Signal, Bulletin 533, 1998 (4 pages).
GE Harris Product Sheet: "Advanced Systems for Optimizing Rail Performance" and "Advanced Products for Optimizing Train Performance," undated (2 pages).
GE Harris Product Sheet: "Advanced, Satellite-Based Warning System Enchances Operating Safety," undated (2 pages).
Furman, E., et al., "Keeping Track of RF," GPS World, Feb. 2001 (6 pages).
Dept. of Transportation Federal Railroad Adminstration, Federal Register, vol. 66, No. 155, pp. 42352-42396, Aug. 10, 2001.
R.C. Kull, "End of Train Monitor System for Caboose Elimination," Vehicular Technology Conference, 1985, 35th IEEE, vol. 35, May 21-23, 1985, pp. 299-303.
GE Harris Product Sheet: "TrainTalk," undated (1 pages).
GE Harris Product Sheet: "IHub," undated (4 pages).
GE Harris Product Sheet: "Powerful, Flexible Train Control In A Single User-Friendly Platform," undated (4 pages).
GE Harris Product Sheet: "Enhancing Current Scheduling, Adds Planning Capabilities and Builds the Foundation for Future Train Control," undated (2 pages).
GE Harris Product Sheet: "Advanced, Expandable Platform for All Your Railroad Cab Electronics," undated (2 pages).
GE Harris Product Sheet: "Capture the Advantages of Total Rail Control and Management," undated (4 pages).
GE Harris Product Sheet: "Universal Brake Control Valve Offers Flexibility and Performance," undated (2 pages).
GE Harris Product Sheet: "Integrated Distributed Power and Electronic Brake System Sets a New Standarad for Safety and Reliability," undated (2 pages).
"Test Confirm PTC Viability," Railway Gazette International, Jul. 1998 (2 pages).
Dept. of Transportation Federal Railroad Adminstration, Code of Fedearl Regulations, Title 49, vol. 4, Revised Oct. 1, 2005, pp. 551-553.
OPS Systems, "Operations, laboratory and Maintenance Software," Ftp://Ftp.Opssys.Com/OPSSupportPolicy.Com, Jan. 1, 2008 (3 pages).
"Motorola's 68HC11x Family of 8-Bit Micro-Controllers," printed Oct. 7, 2008 (6 pages).
AAR Manual of Standards and Recommended Practices: Electronically Controlled Brake Systems: Electronically Controled Pneumatic (ECP) Cable-Based Brake Systems—Performance Requirements: Standard S-4200, pp. E-II 1-E-II 58, Implemented Feb. 2008.
AAR Maunal of Standards and Recommended Practices: Railway Electronics: End-of-Train Communications: Standard S-5701; pp. K-51-K-84, Revised 2005.
Analog Devices, "± g to ± 5g Single Chip Accelerometer with Signal Conditiong: ADXL05," pp. 1-20, 1996.
"HCRQ System Safety, Software Safety Experts," Retrieved: Oct. 29, 2004, <http://www.hcrq.com/Rail.html>.
"IEEE Standard for Verification of Vital Functions in Processor-Based Systems Used in Rail Transit Control," Rail Transit Vehicle Interface Committee of the IEEE Vehicular Technology Society, Approved Mar. 30, 2000, IEEE-SA Standards Board, The Institute of Electrical and Electronics Engineers, Inc., New York, New York, 2000.
"NovAtel FAQs," Retrieved: Nov. 19, 2004, <http://www.novatel.com/Customer_Support/faq14.hmtl>.
Sullivan, Tom, "A Revolution in Serial Trainline Communications," LonMark: Solutions, Retrieved: Oct. 29, 2004, <http://www.lonmark.org/solution/trans/arevolut.htm>, 2002.

Vantuono, William C., "CBTC: A Maturing Technology," Railway-Age, Third International Conference on Communications-Based Train Control, Retrieved: Oct. 29, 2004, <http://www.railwayage.com/jun99/cbtc.html>, Jun. 1999.
International Search Report issued in PCT/US2008/071125, mailed Dec. 19, 2008.
Written Opinion issued in PCT/US2008/071125, mailed Dec. 19, 2008.
Supplementary European Search Report issued in EP 08 79 6598, dated Mar. 15, 2011.
Office Action issued in EP 08 79 6598, mailed Dec. 20, 2011.
Office Action issued in MX/a/2010/001453, mailed Oct. 21, 2011.
English language abstract of DE 197 01 800, published Jul. 9, 1998.
U.S. Appl. No. 11/835,050.
U.S. Appl. No. 11/835,050

* cited by examiner

VITAL SPEED PROFILE TO CONTROL A TRAIN MOVING ALONG A TRACK

BACKGROUND

Train safety is an important issue in the United States and throughout the world. This is true for both passenger trains and for freight trains. Although movement of a train can be directed by a computerized train system in some instances, the movement of the vast majority of trains is directed by a human operator. Reliance on a human operator necessarily creates the possibility of mistakes being made by that operator, and these mistakes can and often do lead to unsafe conditions and, in the worst case, accidents and loss of life and property.

One aspect of train safety is ensuring that trains do not exceed maximum allowable speeds. Maximum allowable speeds can include: 1) upper limits on train speed that may be applicable throughout an entire rail system; 2) permanent maximum speed limits applicable to a certain specific sections of track; and 3) temporary speed restrictions that may be applicable throughout an entire rail system (e.g., a lower speed on hot summer days when there is a possibility of track buckling) or a portion of a rail system (e.g., a restriction on a particular section of track that is undergoing repairs).

A second aspect of train safety is avoiding collisions between trains. Train operators are typically authorized by a signaling system or a dispatcher to move a train from one area (sometime referred to in the art as a "block") to another. The operator is expected to move the train in only those areas for which the train has been authorized to travel. When an operator moves a train outside an authorized area, the possibility that the train may collide with another train that has been authorized to move in the same area arises.

Concern over operator error in complying with speed restrictions and limits on authorized movement has led to a number of systems that attempt to prevent such operator errors. Early versions of such systems, such as the cab signal system, involve the transmission of signal information into a locomotive via a signal transmitted over an electrical power line through which the train receives electrical power for movement. Such systems will take preventive action (e.g., a "penalty" brake application) when the train is moving outside the authorized area. However, this can lead to unsafe conditions because the preventive action does not occur until after the authorized movement limit has been violated.

Other, more sophisticated systems, such as the TRAIN SENTINEL™ system marketed by the assignee of this application, Quantum Engineering, Inc., anticipate when a train will violate a limit on a movement authorization or exceed a speed limit, and take preventive action prior to a violation to ensure that the limit on a movement authorization or the speed limit is not violated. However, this system requires significant onboard computing capability.

An important issue with such train control systems is whether or not they are sufficiently reliable. A relevant industry standard is the IEEE 1483 "Standard for Verification of Vital Functions in Processor-Based Systems Used in Rail Transit Control." This standard includes a definition of what is necessary for a train control system to be considered as "vital."

DETAILED DESCRIPTION

Figure 1:
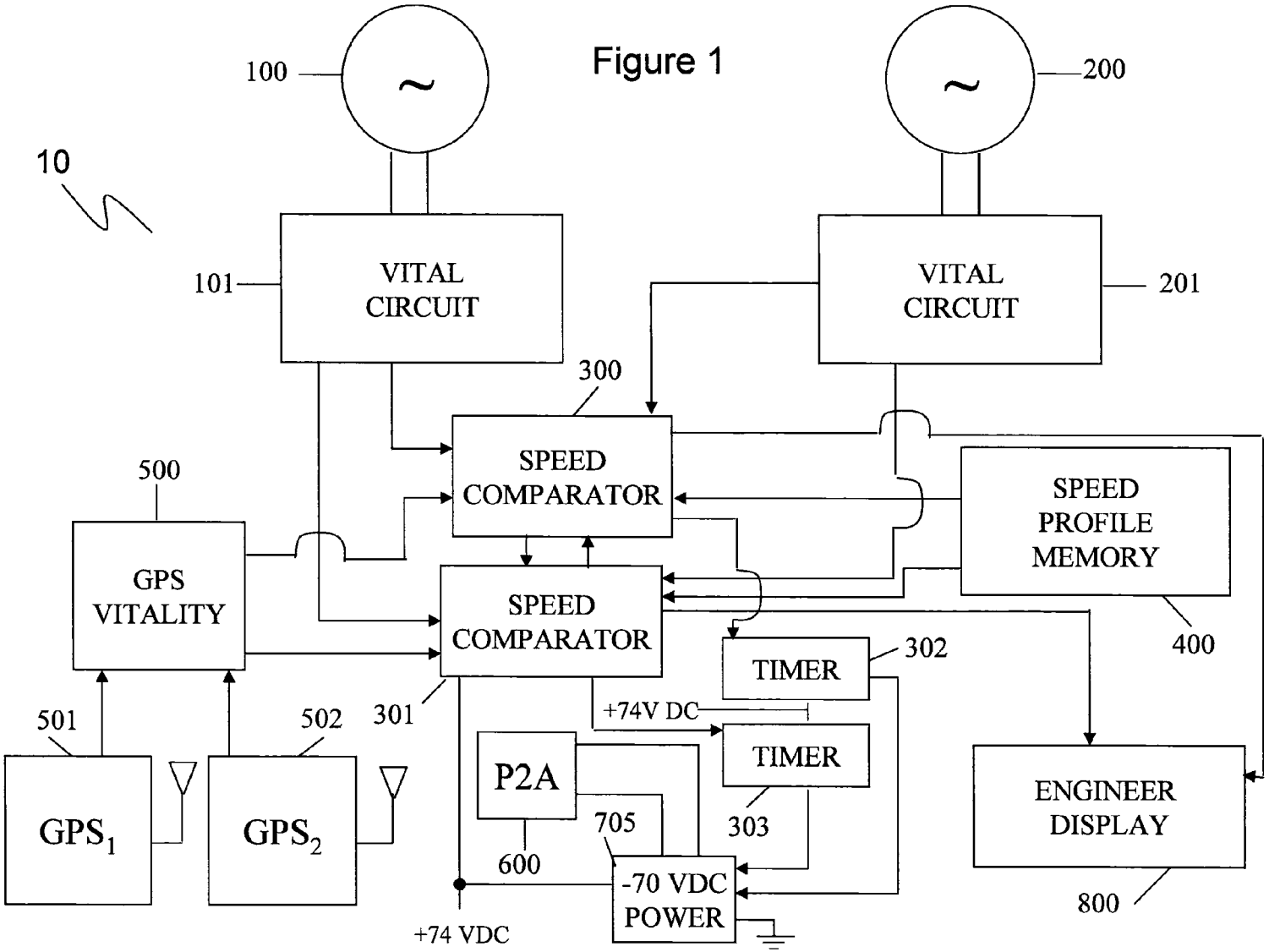
FIG. 1 illustrates a vital onboard control system according to one embodiment.

The present invention will be discussed with reference to preferred embodiments of end of train units. Specific details, such as types of positioning systems and time periods, are set forth in order to provide a thorough understanding of the present invention. The preferred embodiments discussed herein should not be understood to limit the invention. Furthermore, for ease of understanding, certain method steps are delineated as separate steps; however, these steps should not be construed as necessarily distinct nor order dependent in their performance.

In one aspect of the invention, a speed profile is constructed for an entire train trip. The speed profile includes a maximum allowable speed at which the train is allowed to travel at each point of the entire trip, taking into account the ability of the train to comply with speed reductions encountered during the trip. At points in the trip in which the train's speed must be reduced (e.g., at the end point of the trip or at a point in the trip at which a temporary speed restriction results in a decrease of the maximum allowable speed), the speed profile does not simply make a sharp transition at the point in which reduced speed becomes effective. Rather, the speed in the speed profile gradually reduces from the higher speed to the lower speed starting at a point at which the train must begin braking in order to be traveling at the lower speed when the train reaches the point at which the lower speed limit becomes effective. The speed profile may also be lower than a maximum allowable speed in areas of track corresponding to steep downhill grades where a train's brakes may not have sufficient capacity to prevent a train traveling at a maximum allowable speed on an upper portion of a downhill grade from accelerating above the maximum allowable speed on a lower portion of the downhill grade. At the end of the trip, the speed profile gradually decreases to zero to ensure that the train is at zero speed (i.e., the train is stopped) prior to reaching the limit of its authority.

The braking curves (the portions of the speed profile during which the speed is gradually reduced from a higher speed to a lower speed) may be calculated using any method known in the art. In some embodiments, a worst case assumption is made for the weight and speed of the train, the number of cars on the train, the types of brakes on the cars, and the elevation and the grade of the track on which the train is traveling. In other embodiments, one or more sensors are used in order to determine more accurate values for these braking curve parameters. The weight of the train may be entered by the operator at the start of the trip. The speed of the train may be determined through use of a rotation sensor/tachometer attached to an axle or wheel of the train. The grade of the track may be determined through use of a GPS system or rotation sensor dead reckoning system to determine the location of the train coupled with a track database that uses position as an index to return a track grade corresponding to the index.

At a point in the trip at which the maximum allowable speed increases, the speed profile makes a sharp change in some embodiments, which allows the train to accelerate at its maximum allowable rate. In other embodiments, the speed profile may rise gradually from the lower speed to the higher speed, which in effect limits the rate at which the operator can accelerate the train. One reason for doing this is to encourage the operator to conserve fuel by avoiding rapid accelerations.

It is important to ensure that the speed profile is vital. There are several methods that can be used to accomplish this. One method, which is particularly useful in embodiments in which the computing power of the control system onboard the locomotive is limited, is to generate the speed profile on multiple wayside computers, cross check the speed profiles generated on these multiple computers with each other, and then transmitting the verified speed profile to the control system on the locomotive in a vital manner.

In addition to ensuring that the speed profile is vital, it is also necessary to ensure that a vital control system is in place to enforce compliance with the speed profile. In a preferred embodiment, the control system utilizes vital circuits such as those described in U.S. Pat. Nos. 4,368,440 and 3,527,986 to ensure that a signal from a respective axle drive speed sensor is functioning correctly. The speed sensors provide a signal that is indicative of a speed of the train, which can be compared to a maximum allowable speed as indicated by the flight plan discussed above. Preferably, two separate axle drive speed sensors are utilized, each on a different axle.

The results from the axle drives are correlated to each other and against a speed indicated by or derived from a GPS receiver using two redundant speed comparators. The GPS receiver signal is preferably determined to be vital using one or more of the methods described in co-pending U.S. patent application Ser. No. 11/835,050, filed Aug. 7, 2007 and entitled "METHODS AND SYSTEMS FOR MAKING A GPS SIGNAL VITAL," which is incorporated in its entirety by reference herein.

If the speed of the train is determined to exceed the speed profile, corrective action is taken. This corrective action can include warnings to the operator and, if the operator does not act in response to the warnings, can also include an emergency brake activation. An emergency brake activation may be accomplished using, for example, a P2A valve as is known in the art. Such valves are vital in that electrical power must be applied to the valve in order to keep the valve closed to prevent an emergency brake application. In this manner, any disruption to the power supply to the P2A valve results in an emergency brake application. In some embodiments, a voltage not in use elsewhere on the train is used to supply power to the P2A valve. The power supply may be under control of redundant watchdog timers configured such that the absence of a signal from the speed comparator circuits prior to the expiration of a timeout period will result in the disabling of the power supply, which in turn will deenergize the P2A valve thereby triggering an emergency brake application.

FIG. 1 illustrates a vital train control circuit 10 according to one embodiment. The vital circuit 10 includes two axle drive sensors (also sometimes referred to as tachometers and/or revolution counters) 100, 200. The sensors 100, 200 may be of the type known as axle generators that output an alternating current signal whose frequency varies in proportion with the speed of the train. In other embodiments, other types of circuits such as optical tachometers and other devices known to those of skill in the art may be used. Each of the axle drive sensors 100, 200 is preferably associated with a different axle on the train.

Each of the axle drive sensors 100, 200 is preferably connected to a respective vital circuit 101, 201. The function of the vital circuits 101, 201 is to ensure to the extent possible that the sensors are operating correctly. The primary concern with the sensors 100, 200 is that they do not erroneously indicate a zero speed or a speed lower than the true speed. Indications of speeds in excess of the true speed are undesirable because they may result in unnecessary emergency brake applications or may require the train operator to operate the train more slowly than necessary, but false indications of speeds in excess of the true speed are tolerable because they will not result in an unsafe situation as would false zero speeds. In embodiments in which the sensors 100, 200 are of the axle generator type, vital circuits such as those described in U.S. Pat. Nos. 4,368,440, 4,384,250, or 3,527,986, or other vital circuits may be used (those of skill in the art will recognize that other types of circuits are used with other types of sensors such as the optical sensors discussed above). Such circuits pass an alternating current signal from an oscillator through the stator of the axle drive generator to determine whether the axle drive stator is good. These circuits cannot ensure that the mechanical connections from the sensor to the axle and from the axle to the wheel are intact, but this is accounted for by the use of two separate axle sensors on two different axles and by correlation of the axle sensor signals with the additional vital GPS signal as discussed above.

The speeds indicated by the sensors 100, 200 are each input to each of two redundant speed comparators 300, 301. The speed comparators 300, 301 are preferably implemented using microprocessors or other data processing elements. The microprocessor in speed comparator 300 is preferably of a different type, and preferably from a different manufacturer, than the microprocessor in speed comparator 301. Also input to the speed comparators 300 and 301 is a vital GPS signal from GPS vitality circuit 500. The GPS vitality circuit 500 is connected to two GPS receivers 501 and 502. The GPS vitality circuit 500 may be implemented using a microprocessor or other data processing circuit, and may include a memory for storing a track database as described in the above-referenced co-pending commonly owned U.S. patent application Ser. No. 11/835,050. The GPS vitality circuit 500 may be a implemented on the same microprocessor as one of the speed comparator circuits 300, 301 or may be implemented on a separate microprocessor. A memory (e.g., a magnetic disk storage device or other memory, preferably but not necessarily non-volatile) 400 with the speed profile is also connected to each of the speed comparators 300, 301.

The speed comparators 300, 301 ensure that the speeds indicated by each of the axle sensors 100, 200 and the speed from the GPS vitality circuit 500 are correlated. In some embodiments, this is done by simply comparing the speeds and ensuring that they are within an acceptable error of each other. In other embodiments, more sophisticated methods are used. These methods may include accounting for areas in which wheel slippage may occur (e.g., where the grade of the track is significant) such that excessive speeds from one of the axle sensors 100, 200 do not trigger an error. If the speeds from any of the three speed inputs do not correlate, corrective action is taken. In some embodiments, the corrective action may include warning the operator that there is an apparent malfunction and, if the operator does not respond, initiating an emergency brake application. For example, warnings may be presented to the operator via a display 800. Other forms of corrective action may also be used, and some embodiments include track databases that indicate areas in which the GPS receiver is unable to receive transmissions from the GPS satellites.

The speed comparators 300, 301 also determine a calculated train speed using the inputs from the axle sensors 100, 200 and the GPS vitality circuit 500 and compare this calculated train speed to the speed profile in the memory 400. If the calculated train speed exceeds the speed from the speed profile corresponding to the present position of the train, corrective action is taken. (The present position of the train may be determined in any number of ways, including by using the position reported by the GPS receivers 501, 502, by integrating speed from the axle sensors 100, 200, through the use of a transponder system, or any combination of the foregoing. The aforementioned U.S. patent application Ser. No. 11/835,050 includes several methods that may be utilized to determine train position accurately.) In some embodiments, the corrective action includes warning the operator and, if the train speed is not reduced below the corresponding speed in the speed profile, an emergency brake application is triggered as described below.

The speed comparators 300, 301 must each send a periodic reset to a corresponding one of two watchdog timers 302, 303 to prevent them from timing out. The watchdog timers 302, 303 may be implemented as simple counters in some embodiments. This message is preferably transmitted at short intervals, such as every 10 milliseconds. If either of the watchdog timers 302, 303 fails to receive one of these periodic reset pulses from the corresponding speed comparators 300, 301, a timeout occurs resulting in an interruption of power from the power supply 705 to the P2A valve 600, thereby triggering an emergency brake application. In the event that one of the speed comparators 300, 301 determines that the operator has failed to reduce the speed of the train to a speed below the corresponding speed from the speed profile, the speed comparator 300, 301 initiates an emergency brake application by not sending a reset pulse to the corresponding watchdog timer 302, 303.

Each of the watchdog timers 302, 303 is connected to a power supply 705. If either of the watchdog timers 302, 303 signals the power supply that it has timed out (which may be due to a failure of one of the speed comparators 300, 301 or may be because the operator has not reduced the speed of the train to the allowable speed indicated by the speed profile), the power supply 705 is configured to interrupt the supply of power to the P2A valve 600 to cause an emergency brake application. In some embodiments, the power supply 705 is configured to produce a unique voltage not used elsewhere on the train to reduce the possibility that a short results in the unintended application of power to the P2A valve 600.

Figure 2:
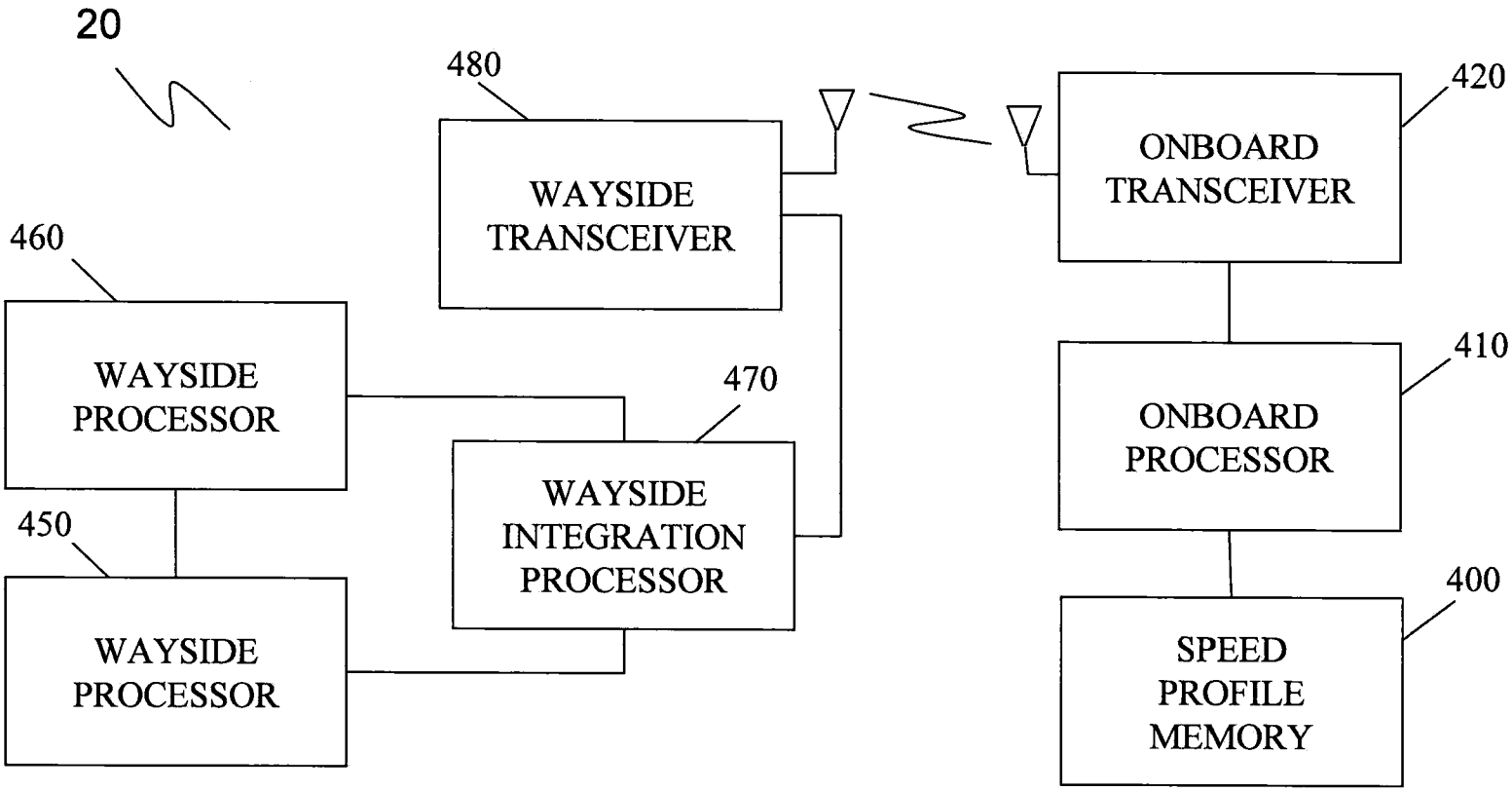
FIG. 2 is a block diagram of a system including wayside equipment and a portion of the onboard control system shown in FIG. 1.

As discussed above, the speed profile is stored in the memory 400. Calculating the speed profile and storing it in the memory is accomplished in a number of different ways in various embodiments, one of which is illustrated in the system 20 of FIG. 2. The system 20 includes both wayside and onboard equipment. Located along the wayside are a pair of redundant wayside processors 450, 460. Each of the wayside processors 450, 460 is responsible for calculating a speed profile for at least a portion of the train trip taking into account elevation, curvature, authority limits, temporary and permanent speed restrictions. In some embodiments, there are multiple pairs of wayside processors along a train's route, and each pair is responsible for calculating the speed profile for an assigned track segment. In other embodiments, the processors are staggered such that there are always two processors responsible for calculating a speed profile for any particular point on the track, but each processor calculates a speed profile for a portion of track that corresponds in a first part to a first other processor and in a second part to a second other processor. The first alternative will be discussed in further detail below.

As discussed above, the speed profile includes a maximum allowable speed for the train along each point of the trip, and this maximum allowable speed may be less than the posted maximum allowable speed. Preferably, the wayside processors 450, 460 are manufactured by different manufacturers and are preferably running different software. The speed profiles calculated by each of the two wayside processors 450, 460 are compared to each other by the wayside integration processor 470. If the two speed profiles do not match, an error is declared. If the two speed profiles do match, one of the speed profiles is transmitted in a message via the wayside transceiver 480 to a transceiver 420 onboard the train. The message received by the onboard transceiver 420 is processed by an onboard processor 410. This processing includes, at a minimum, verifying that the checksum for the message is correct by an onboard processor 410 (which may be a separate processor or may be performed by one of the other processors discussed above in connection with FIG. 1, such as one of the speed comparators 300, 301). If the speed profile message is correct, the speed profile is stored in the speed profile memory 400 for use by the speed comparators 300, 301 as described above.

A particular embodiment of a vital system for ensuring that a train does not exceed a maximum allowable speed as it moves along a track has been shown above. Those of skill in the art will recognize that numerous variations on the embodiment shown above are possible. Such variations include using less than all of the redundancy discussed above. For example, alternative embodiments may use a single GPS receiver rather than two GPS receivers, or a single axle sensor rather than two axle sensors. Different types of components may also be used (e.g., inertial navigation systems rather than GPS receivers, or optical axle sensors rather than electromagnetic axle drive generators). A single watchdog timer driven be each of the speed comparator circuits is employed in some embodiments. In yet other embodiments, a single speed comparator is utilized. It will be apparent to those of skill in the art that numerous other variations in addition to those discussed above are also possible. Therefore, while the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

Furthermore, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the present invention in any way.

What is claimed is:

1. A system for ensuring that a train is not operated above an allowable speed limit on a trip, the system comprising:

a memory for storing a speed profile, the speed profile including a maximum allowable speed of the train for each point of the trip, the speed profile including a braking curve corresponding to a portion of the trip in which the maximum allowable speed transitions from a higher speed to a lower speed, the braking curve being configured to cause a gradual train speed reduction starting at a point of the trip before the portion of the trip in which the maximum allowable speed transitions from the higher speed to the lower speed;

at least two axle sensors, each axle sensor being configured for connection to a different axle on a train;

a pair of vital circuits, each vital circuit in the pair being connected to a respective axle sensor, each vital circuit being configured to confirm that at least some portion of the respective axle sensor to which the vital circuit is connected is functioning properly;

a pair of speed comparators, each speed comparator being connected to at least one of the vital circuits, each speed comparator having an output connected to an input of a power supply;

a power supply connected to the output of each of the comparators; and a valve connected to the power supply and in fluid communication with an air brake pipe, the valve being configured such that it remains closed when power from the power supply is supplied to the valve and causes an application of the train's brakes when power from the power supply is not supplied to the valve;

wherein each of the speed comparators is configured to control its respective output such that the power supply does not supply power to the valve when a speed of the train exceeds a maximum allowable speed as indicated in a corresponding portion of the speed profile.

2. The system of claim 1, wherein the braking curve is based at least in part on a grade of the track to which the speed profile pertains and a weight of the train.

3. The system of claim 1, further comprising at least one global positioning system (GPS) receiver connected to supply data to at least one of the speed comparators.

4. The system of claim 3, wherein the at least one GPS receiver supplies data to both of the speed comparators.

5. The system of claim 1, further comprising:

a first GPS receiver;

a second GPS receiver; and a GPS vitality circuit connected to the first GPS receiver and the second GPS receiver and at least one of the speed comparators, the GPS vitality circuit being configured to correlate information from the first GPS receiver and the second GPS receiver and supply the correlated information to the at least one of the speed comparators.

6. The system of claim 1, further comprising:

a pair of timers, each of the timers being connected between a respective speed comparator and the power supply, wherein each timer is configured to control the power supply to stop providing power to the valve if a signal is not received from its respective speed comparator within a predetermined time period.

7. The system of claim 1, wherein at least one of said axle sensors is an axle generator.

8. The system of claim 7, wherein at least one of said vital circuits is configured to pass an alternating current signal from an oscillator through a stator of the at least one axle drive generator to which it is connected.

9. The system of claim 1, wherein at least one of said axle sensors is an optical sensor.

10. The system of claim 1, wherein the power supplied to the valve by the power supply is different in at least one parameter than power supplied to any other component on the train.

* * * * *